US008047585B1

(12) United States Patent
Peabody et al.

(10) Patent No.: US 8,047,585 B1
(45) Date of Patent: Nov. 1, 2011

(54) SURFACE MOUNTED ELECTRIC STRIKE FOR RELEASING REMOTE PANIC EXIT DEVICES

(75) Inventors: Joshua Todd Peabody, Phoenix, AZ (US); Leland J. Hanchett, Jr., Phoenix, AZ (US); Michael A. Webb, Phoenix, AZ (US); Dominik Scheffler, Phoenix, AZ (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 932 days.

(21) Appl. No.: 12/070,201

(22) Filed: Feb. 13, 2008

Related U.S. Application Data

(60) Provisional application No. 60/901,495, filed on Feb. 14, 2007.

(51) Int. Cl.
*E05B 15/02* (2006.01)

(52) U.S. Cl. ..... 292/341.16; 292/340; 292/341.17; 292/341.15

(58) Field of Classification Search ..... 292/341.16, 292/341.17, 341.15, 340
See application file for complete search history.

(56) References Cited

U.S. PATENT DOCUMENTS

| | | | | |
|---|---|---|---|---|
| 4,836,707 | A * | 6/1989 | Myers | 403/322.4 |
| 5,915,766 | A * | 6/1999 | Baumeister et al. | 292/341.15 |
| 6,390,520 | B1 * | 5/2002 | Holzer | 292/341.17 |
| 6,595,563 | B2 * | 7/2003 | Kiernan | 292/341.16 |
| 7,021,684 | B2 * | 4/2006 | Orbeta et al. | 292/341.16 |
| 7,438,335 | B1 * | 10/2008 | Uyeda | 292/341.16 |

* cited by examiner

*Primary Examiner* — Thomas A Beach
*Assistant Examiner* — Mark Williams
(74) *Attorney, Agent, or Firm* — Woods Oviatt Gilman LLP

(57) ABSTRACT

A surface mounted electric strike for use with an exit device such as a rim panic exit device. The electric strike has a housing with at least one keeper pivotally mounted to the housing. Each keeper has an associated cam with a detent. Release pawls engage detents on the cam in the locked position. A solenoid-operated unlock bar has stops, the position of which establishes whether the keepers are in a locked or unlocked position. The electric strike can be installed in either a fail safe or fail secure mode by locating the stops when the solenoid is de-energized in either a position which blocks or releases the release pawls. Other arrangements for establishing a selected operational mode include use of dual solenoids, use of dual locking bars and reversible release pawls.

7 Claims, 15 Drawing Sheets

SURFACE MOUNTED ELECTRIC STRIKE FOR RELEASING REMOTE PANIC EXIT DEVICES

CROSS REFERENCE IS MADE TO RELATED APPLICATION

This application is partially based on U.S. Provisional Patent Application Ser. No. 60/901,495, filed Feb. 14, 2007, entitled "Electric Locking Device."

FIELD OF THE INVENTION

This invention relates to an electric door strike with a keeper or keepers subject to the action of a release pawl, a solenoid, and an unlock bar which is selectively positioned for releasing or locking a door latch.

BACKGROUND OF THE INVENTION

U.S. Pat. No. 6,390,520, assigned to Hanchett Entry Systems, Inc., describes a surface-mounted electric door strike which provides the capability of releasing a door latch of the type normally used by a rim panic exit device. The name for this particular lock set is derived from the fact that it is mounted on an exit door, has a latch that engages with the rim portion of the door jamb and is used for egress especially in panic situations. The above-mentioned patent uses transmission and release levers mounted to the housing to accomplish release or locking of the keeper or keepers.

In addition, this patent incorporates fail safe and fail secure modes of operation, the switching between which is accomplished by resetting the starting position for the release lever and repositioning the actuating coil thus giving a three state; locked, unlocked, and locked capability.

The device set forth herein provides a simplified method of controlling the locked, or unlocked state of the keepers while maintaining the capability of providing fail safe or fail secure operation.

BRIEF SUMMARY OF THE INVENTION

It is an object of the present invention to provide an electric door strike which can be used in either a fail safe or fail secure mode. In the fail secure mode, the electric strike is locked without electrical power present and unlocked when electrical power is supplied. In the fail safe mode, the electric strike is locked with power supplied and unlocked when power is removed.

It is a further object of this invention to provide a locking mechanism for an electric door strike which reduces the number of parts required to effect a locking or unlocking while at the same time providing a reduction of forces acting upon that structure.

It is still another object of the invention to provide a surface mount electric door strike which eliminates the need to cut into a door jamb for installation.

Briefly, the electric strike of the present invention has a surface mountable housing having a cavity which receives the latch bolt of an exit device. A keeper or keepers having a cam close the opening to the cavity in the locked position. Release pawls engage detents on the surface of the cam in the locked position. A solenoid-operated unlock bar has stops, and the position of this bar, and its stops, establishes whether the keepers are in a locked or unlocked condition. The electric strike can easily be installed in either a fail safe or fail secure mode by selectively locating the solenoid so the stops on the unlock bar, when the solenoid is de-energized, are positioned to establish the selected operational mode. Other arrangements for establishing a selected operational mode include the use of two solenoids, use of dual locking bars or reversible release pawls.

BRIEF DESCRIPTION OF THE DRAWINGS

The above and other advantages and objects of the present invention will become more apparent from the following description, claims and drawings in which:

DETAILED DESCRIPTION OF THE DRAWINGS

Figure 1A:
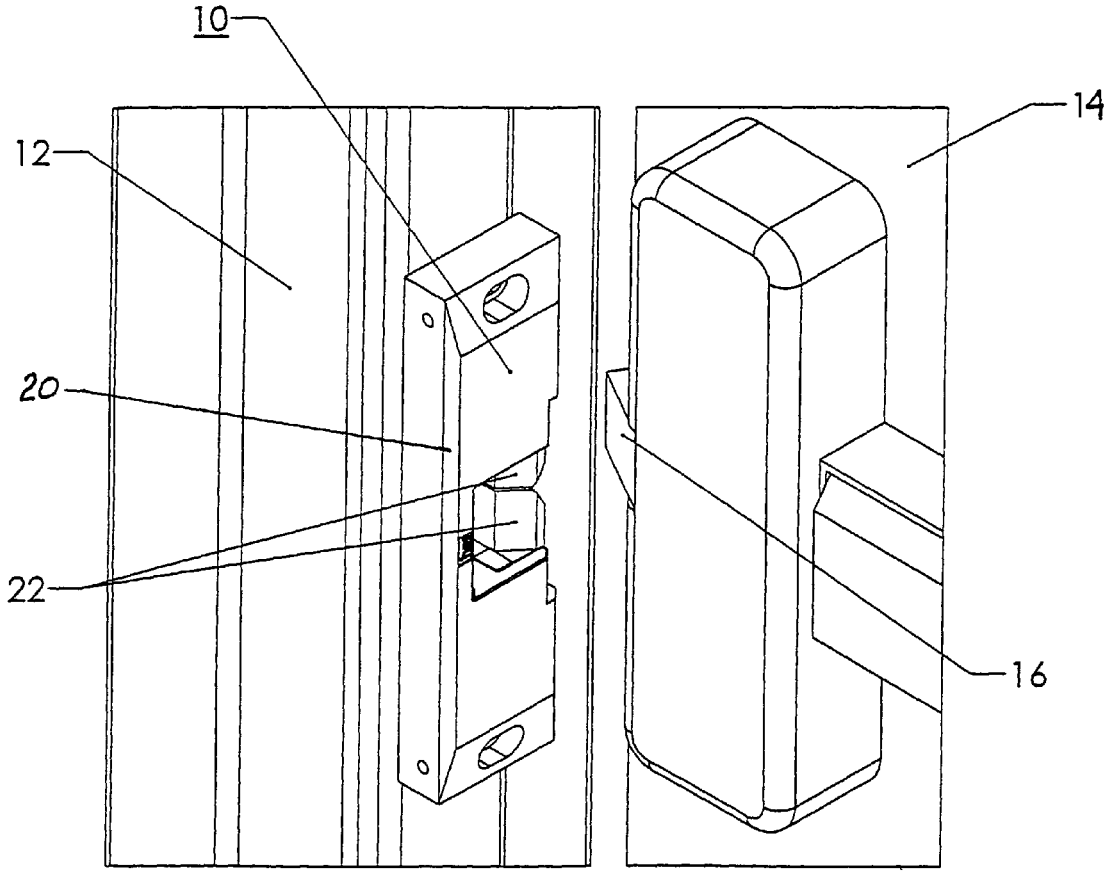
FIG. 1*a* is a rear and side perspective view of the present invention shown mounted on a door jamb so as to operate with the associated door and rim panic exit device with latch bolt.
Figure 1B:
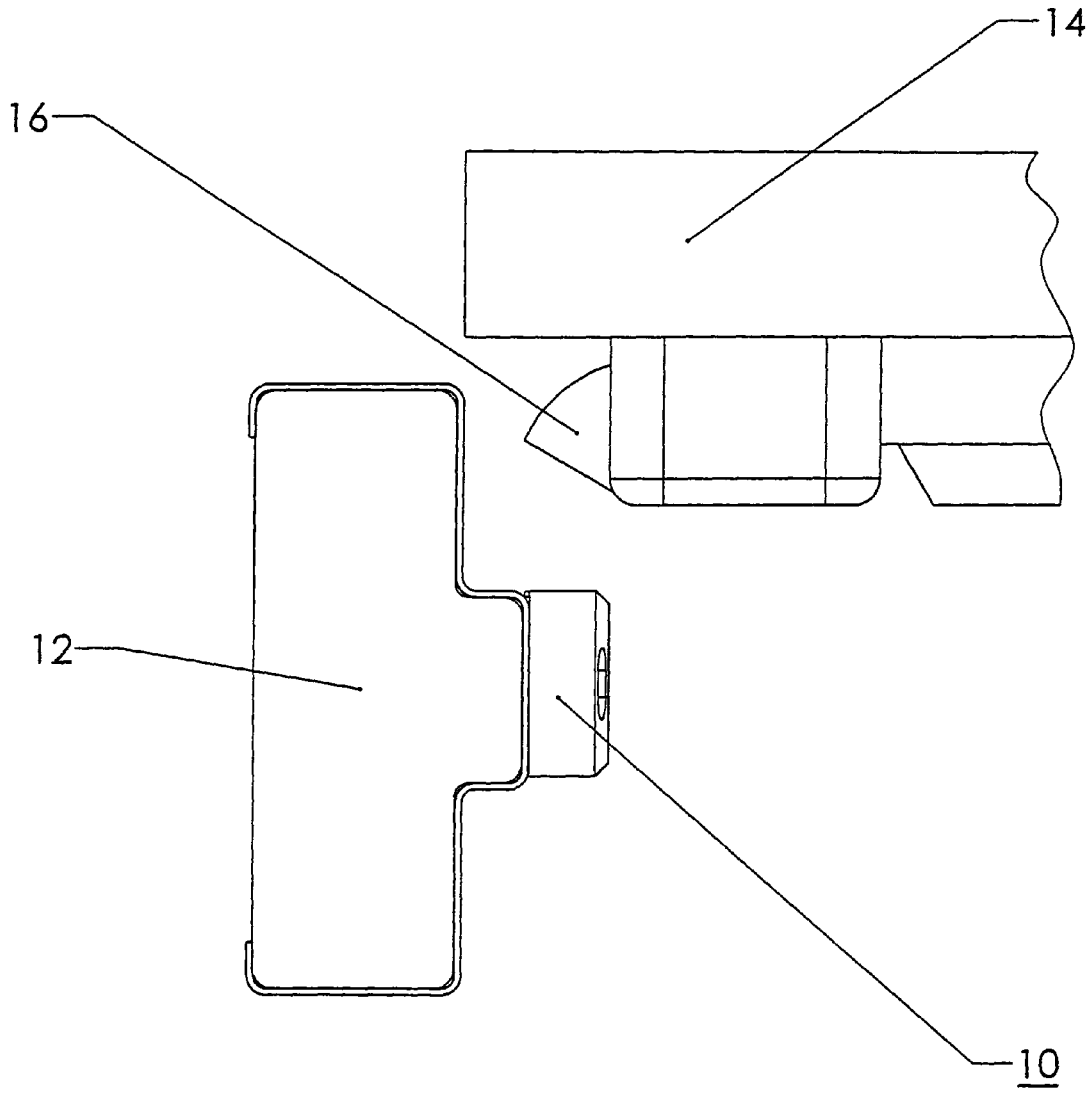
FIG. 1*b* is a top view showing the relative positions of the surface mounted electric strike and door with its associated rim panic exit device when the door has been move to the slightly opened position.

Turning now to the drawings, and more particularly to FIGS. 1*a*, 1*b*, 2 and 3, which show an electric strike 10 for opening a door comprising a housing 18 mounted to a door jamb 12. A cover 20 protects the interior of housing 18 from tampering as well as from dirt, dust and the like while adding strength to the structure. Housing 18 and cover 20 define a cavity C having an opening and are adapted to receive a latch bolt L of a rim panic exit device 16 mounted on the door 14, shown in FIGS. 1A and 1B.

Figure 2:
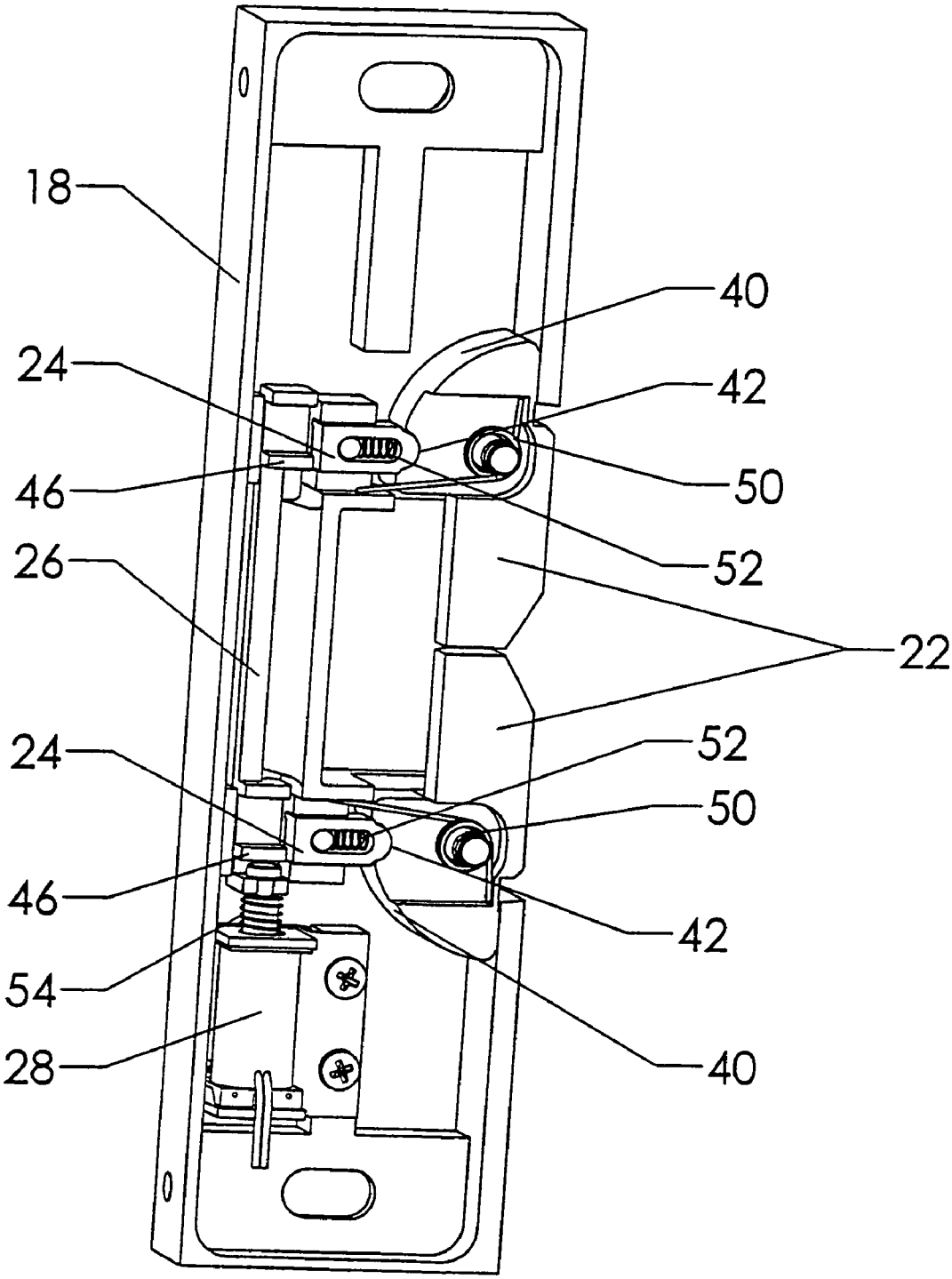
FIG. 2 is a rear perspective view of the present invention, with the cover removed therefrom, shown with the keepers, release pawls and unlock bar in a locked position.
Figure 3:
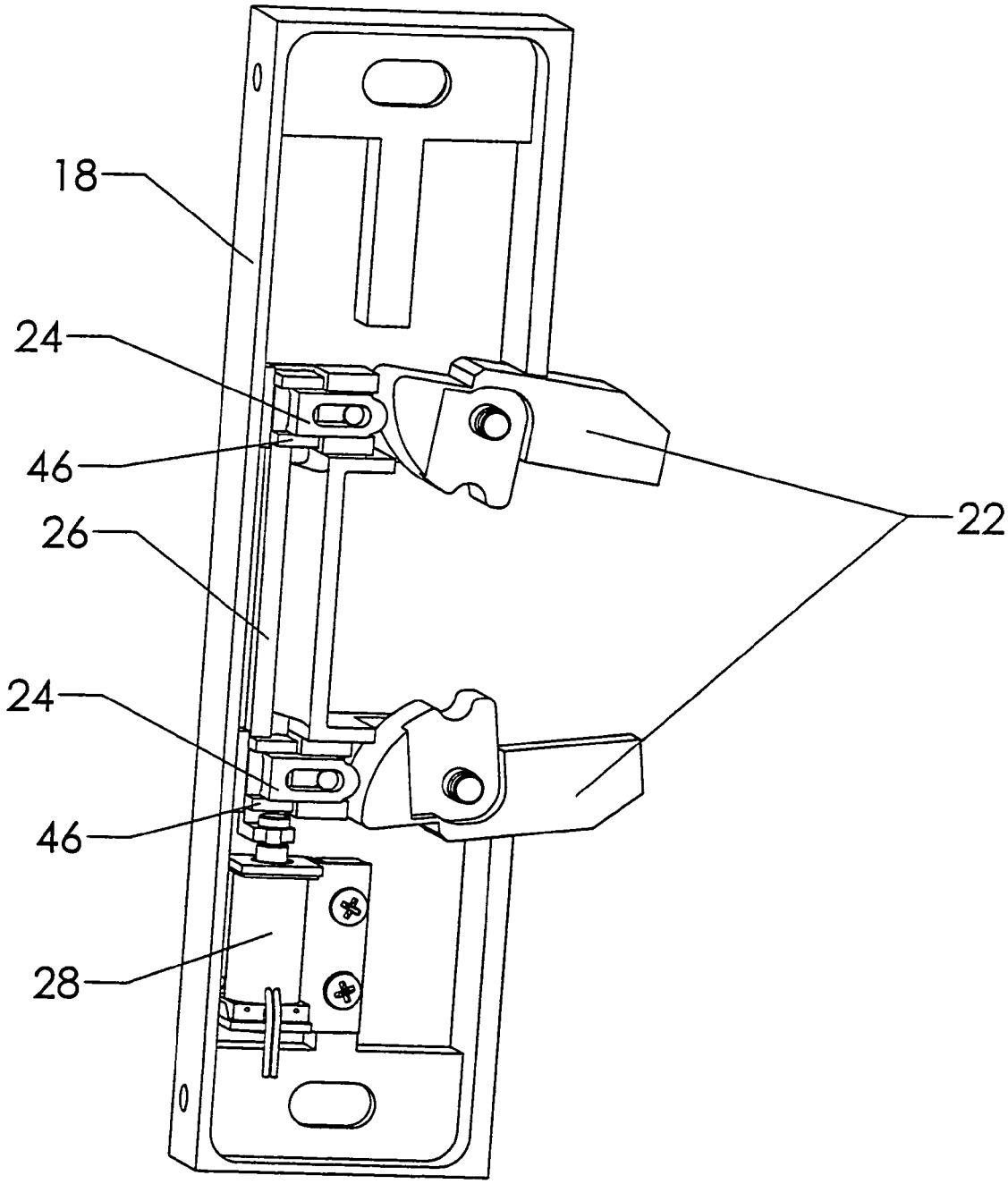
FIG. 3 is a rear perspective view of the present invention, with the cover removed therefrom, shown with the keepers, release pawls and unlock bar in an unlocked position.

As best shown in FIGS. 2 and 3, keepers 22 are biased to the closed position by springs 50 and positioned so as to close off the opening into the cavity C in the housing 18 when the strike is in the locked condition. Release pawls 24 are forced to the locked position by springs 52 and engage detents 42 in the cam surfaces 40 of keepers 22, thus prohibiting rotation of the keeper into the unlocked condition. Unlock bar 26 is reciprocal within the housing and is biased in the upward position by spring 54. Unlock bar 26 has spaced-apart stops 44 and 46 at its opposite ends associated with the adjacent pawl 24. The stops at each end are separated by a space or recess 45. The position of these stops affixed to the unlock bar 26, with respect to the release pawls 24, determines whether the keepers 22 are in a locked or unlocked condition.

Figure 4:
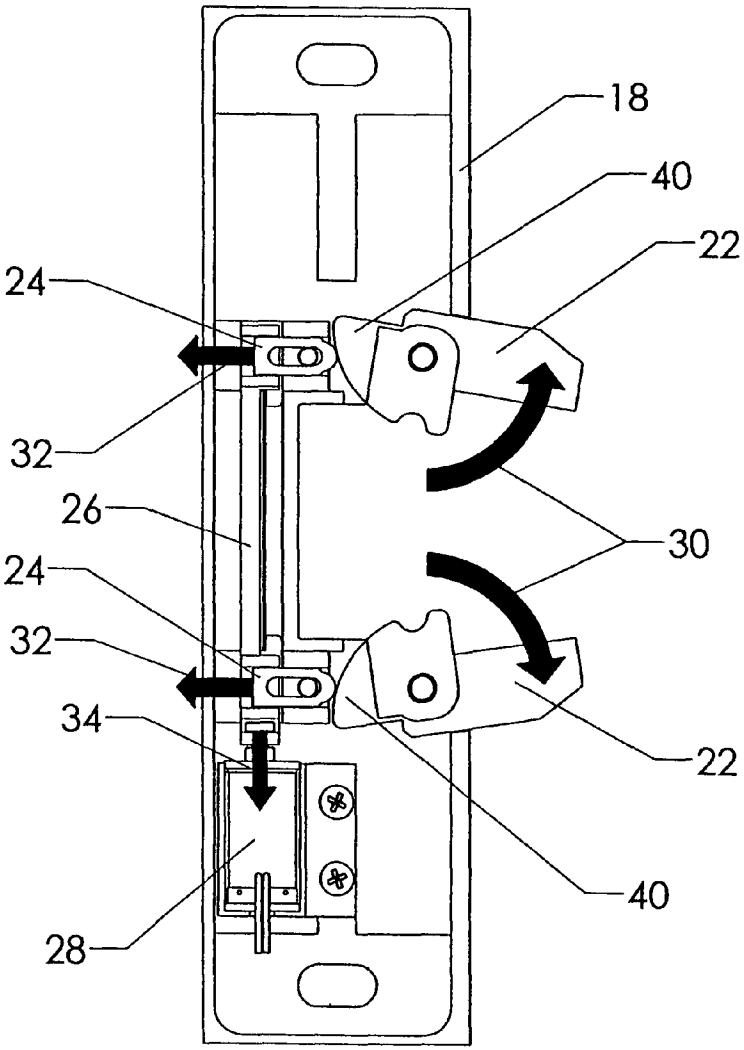
FIG. 4 is a rear view of the present invention, with the cover removed therefrom, showing the direction of initial movement and final position of the unlock bar, followed by the movement of the keeper or keepers, and the release pawls to bring the electric strike into an unlocked condition in the fail secure mode.

Solenoid 28, with an internally captive plunger, controls the movement of unlock bar 26. When energized, in the fail secure mode, the solenoid 28 pulls the stops 46 downwardly disengaging them from their associated release pawl 24 to allow the cam surfaces 40 on the keepers 22 to depress the pawls 24 in a rearward direction in recesses 45 against their normal spring loading as shown in FIG. 4. This occurs as the latch bolt on the rim panic bar 16 moves the keepers 22 outwardly from the cavity C through the opening to the unlocked position.

Figure 5:
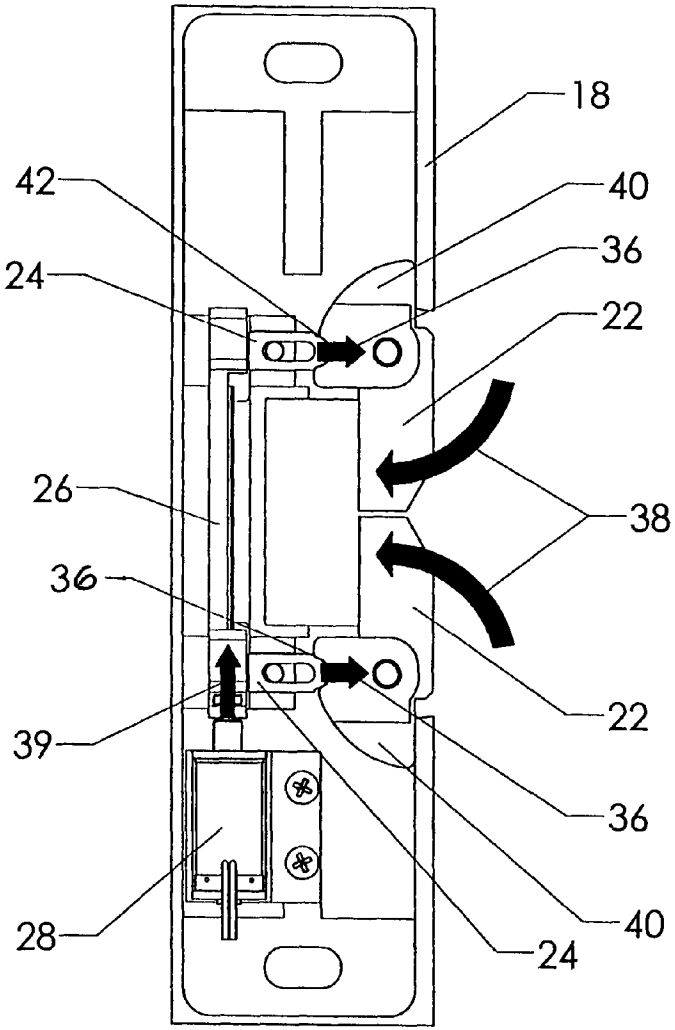
FIG. 5 is a rear view of the present invention, with the cover removed therefrom, showing the direction of movement of the keeper or keepers the release pawls, and the unlock bar to bring the electric strike into a locked condition in the fail secure mode.

FIGS. 4 and 5 show the forces involved and the direction of motion for the keepers 22, release pawls 24 and unlock bar 26 for the fail secure mode of operation. In FIG. 4, the solenoid 28, once energized, pulls the unlock bar 26 in the direction of arrow 34, moving the release pawl into alignment with recess 45. Force may then be applied to the rim panic exit device to open the keepers 22 as shown by arrows 30. The cams 40 on the keepers then cause rearward movement of the release pawls 24 as shown by arrows 32.

FIG. 5 shows the direction of motion of the keepers 22, once the rim panic exit device latch has passed through the opening in housing 18 against the spring bias on the keepers as indicated by arrows 38. Once the keepers 22 have returned to their locked position then release pawls 24 return to engage the detents 42 in the keeper cams 40, as shown by arrows 36. The unlock bar 26 is free to return by spring force shown as arrow 39 to its locked position.

Figure 6:
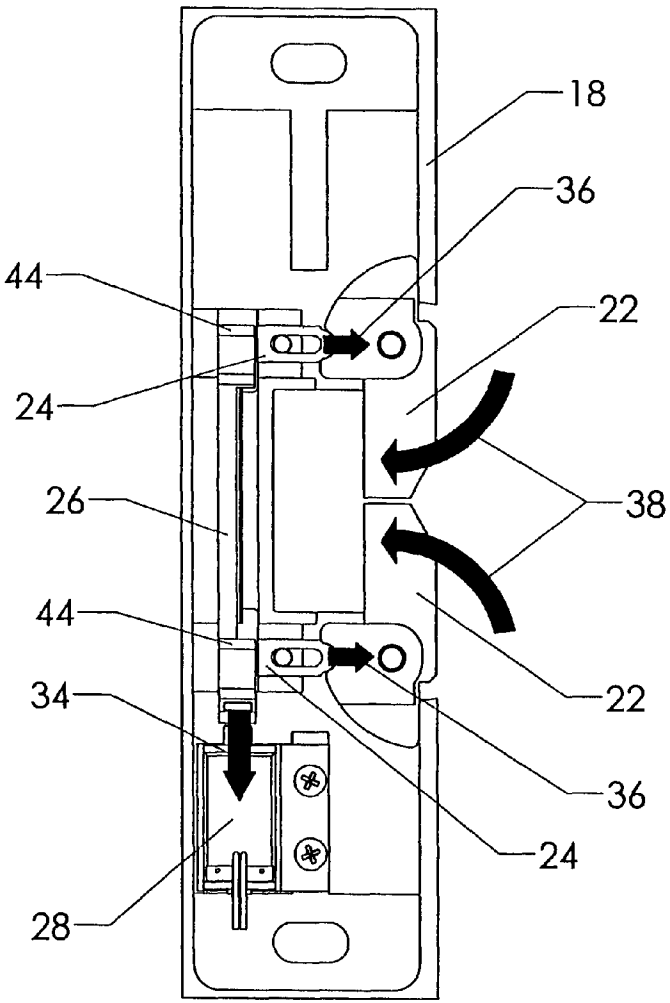
FIG. 6 is a rearview of the present invention, with the cover removed therefrom, showing the initial movement and final location of the unlock bar, and the final location of the release pawls and the keeper or keepers to bring the electric strike into a locked condition in the failsafe mode.
Figure 7:
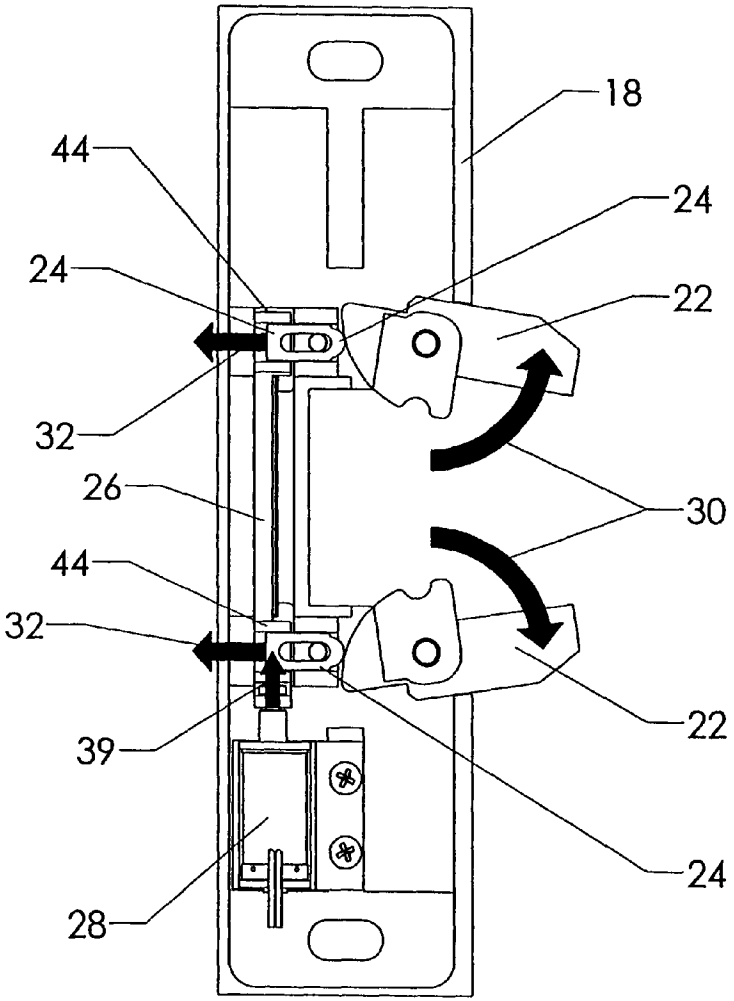
FIG. 7 is a rearview of the present invention, with the cover removed therefrom, and showing the initial direction and final location of the unlock bar to allow movement of the release pawls so as to disengage them from the detent in the keeper cams to bring the electric strike into an unlocked condition in the fail safe mode.

FIGS. 6 and 7 show the locked and unlocked condition in the fail safe mode of operation. In FIG. 6, the keepers 22 are in the closed position as shown by arrows 38 and release pawls 24 are urged into the detents in keeper cams 40 by their internal springs as shown by arrows 36. The unlock bar 26 may be drawn down by energizing the solenoid 28 so that the failsafe stops 44 on the unlock bar 26 are positioned blocking rearward movement of the release pawls 24 thereby placing keepers 22 in the locked state.

FIG. 7 again shows the failsafe mode of operation. In this case the solenoid 28 has been de-energized and the failsafe stops 44 on the unlock bar 26 have moved upwardly by spring 54, as shown by arrow 39. The latch of the rim panic exit device 16 is now free to pivot keepers 22 in the direction shown by arrows 30 thus depressing release pawls 24 in the direction shown by arrows 32 and placing the electric strike in an unlocked condition.

Figure 11A:
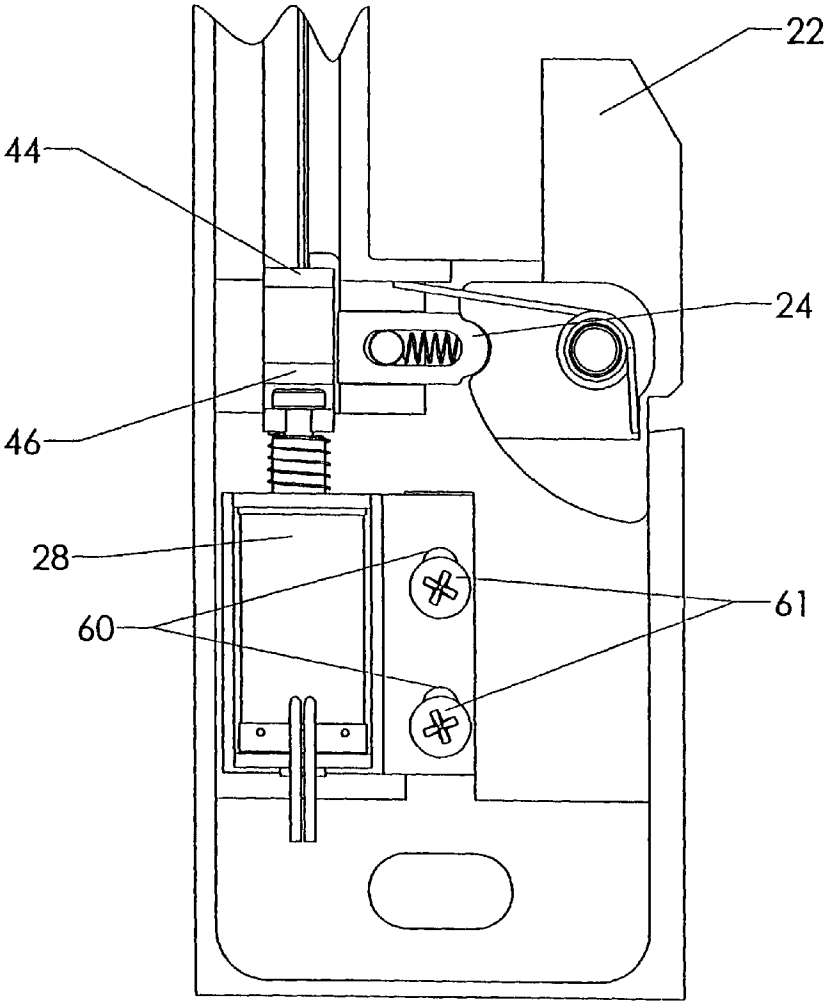
FIGS. 11*a* and 11*b* show the solenoid and its mounting with provision for adjusting same to the fail secure or fail safe mode of operation.
Figure 11B:
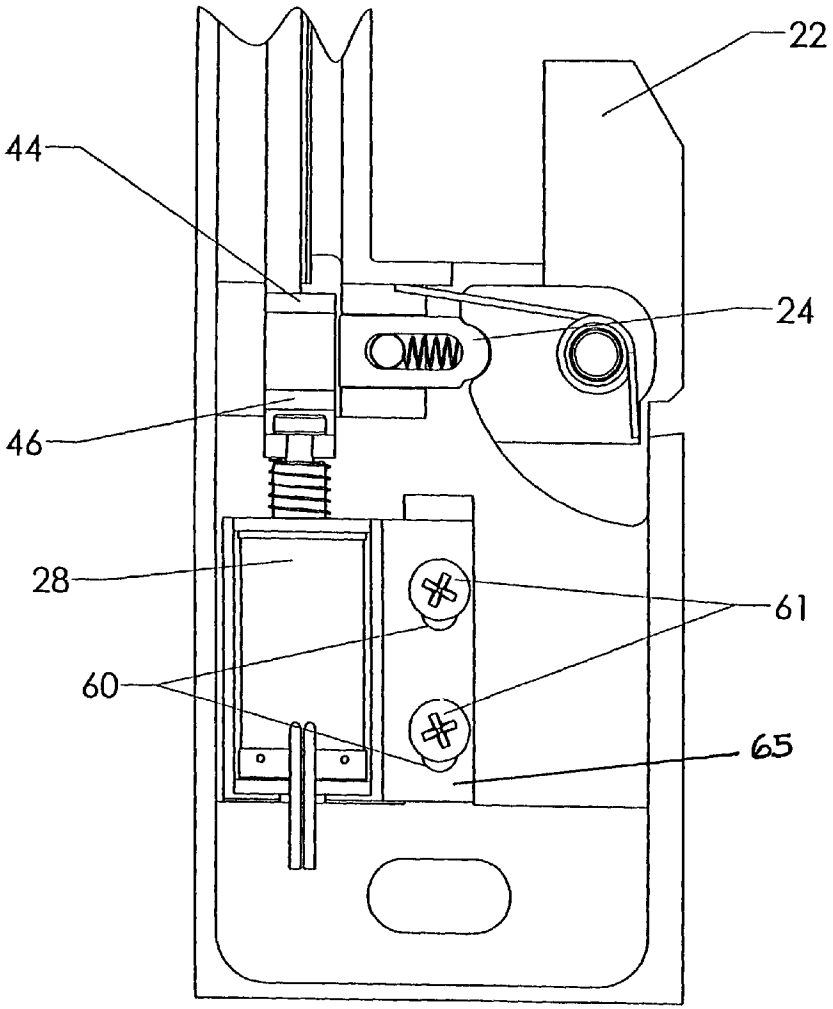
Figure 12A:
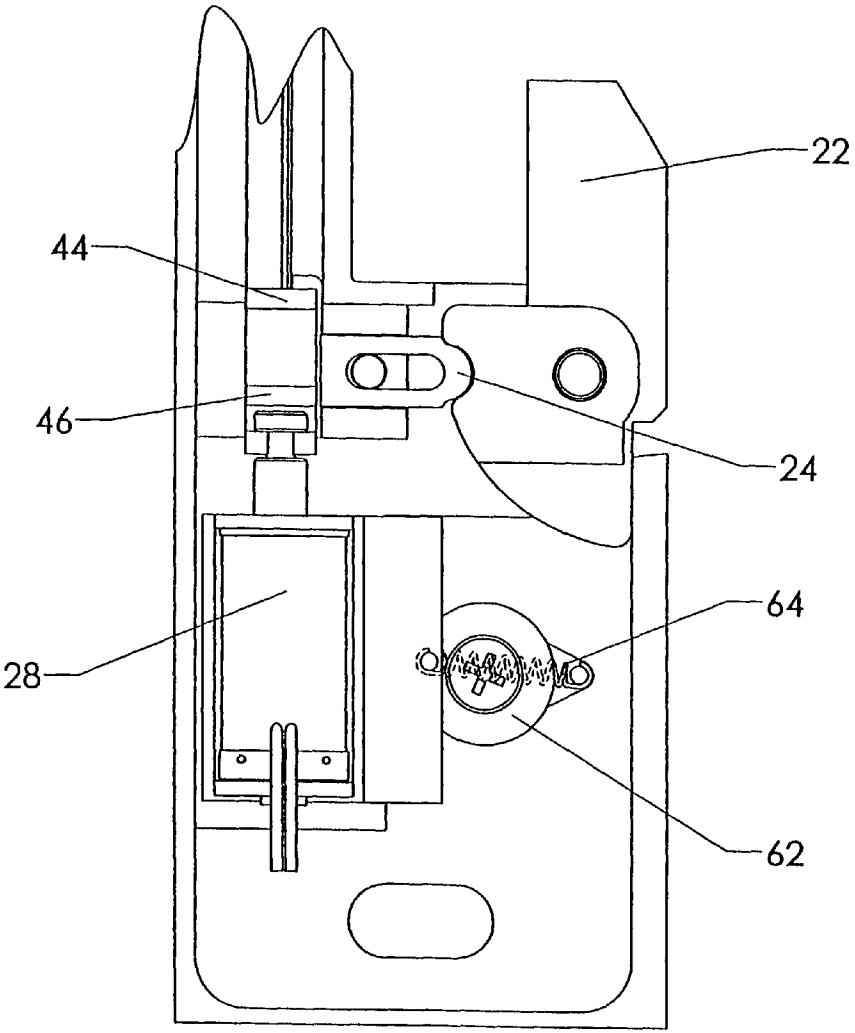
FIGS. 12*a* and 12*b* show a two stop cam which may be used to selectively position the solenoid to establish the selected mode of operation.
Figure 12B:
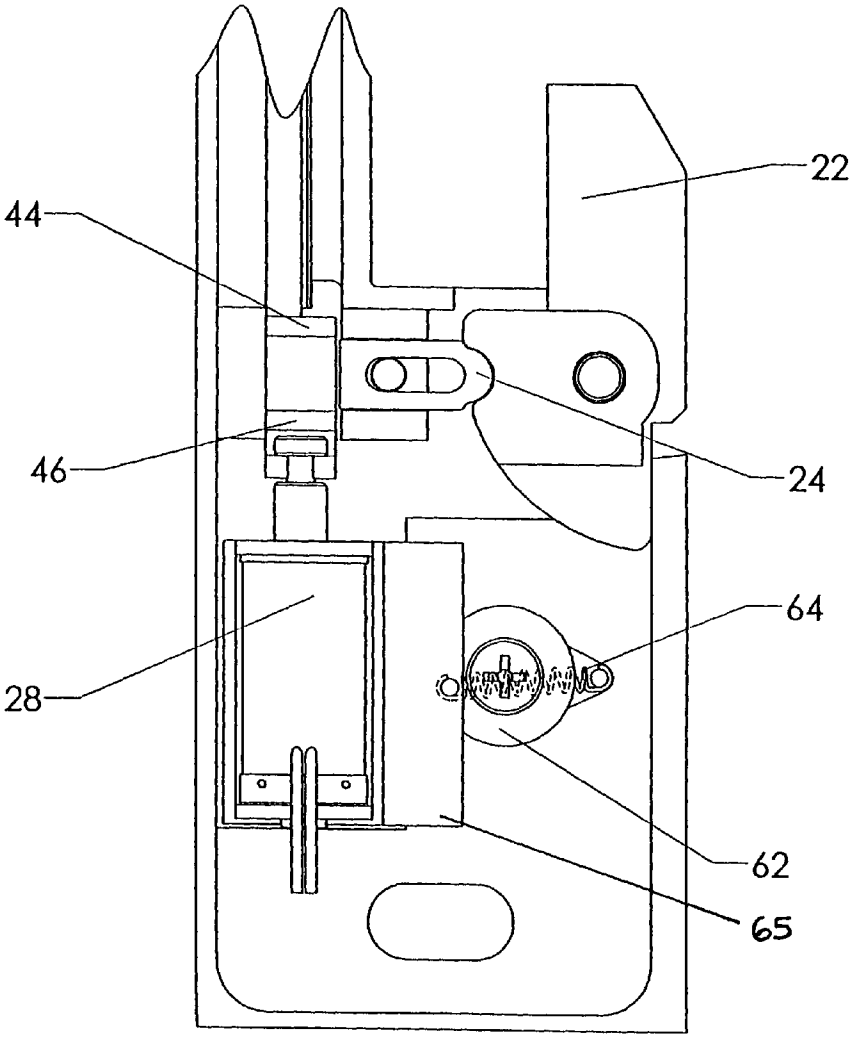

Modification from fail secure to failsafe modes of operation is easily accomplished by means for selectively positioning the locking bar in either a fail safe or fail secure mode when the operator is not energized. This is accomplished by simply repositioning solenoid 28 so that the fail safe stops 44 on the unlock bar are positioned to block the release pawls 24 in place of the fail secure stops 46 on the unlock bar 26. The unlock bar 26 is designed with a three state, locked, unlocked, and locked arrangement so that simple repositioning of the solenoid 28 and its attached lock bar 26 enable convenient conversion from fail secure to failsafe which can be accomplished in the field. The bar has spaced-apart fail safe stops 44 and fail secure stops 46 on opposite ends. The stops are separated by a recess 45 which will permit rearward movement of the associated release pawl when the recess and release pawl are in alignment. The repositioning can be accomplished in a number of ways. For instance, the solenoid 28 may be mounted to a plate 65 with slots 60 receiving mounting screws 61 as shown in FIGS. 11*a* and 11*b*. Multiple threaded holes may be provided instead of the slots 60. As seen in FIGS. 12*a* and 12*b*, the solenoid 28 and mounting plate 65 are secured to a two stop cam mechanism 62 by a spring 64. The cam is rotatable to establish one of two positions for the solenoid 28, depending on the mode of operation. FIG. 12*a* shows the fail secure position and FIG. 12*b* shows the fail safe position.

Figure 8:
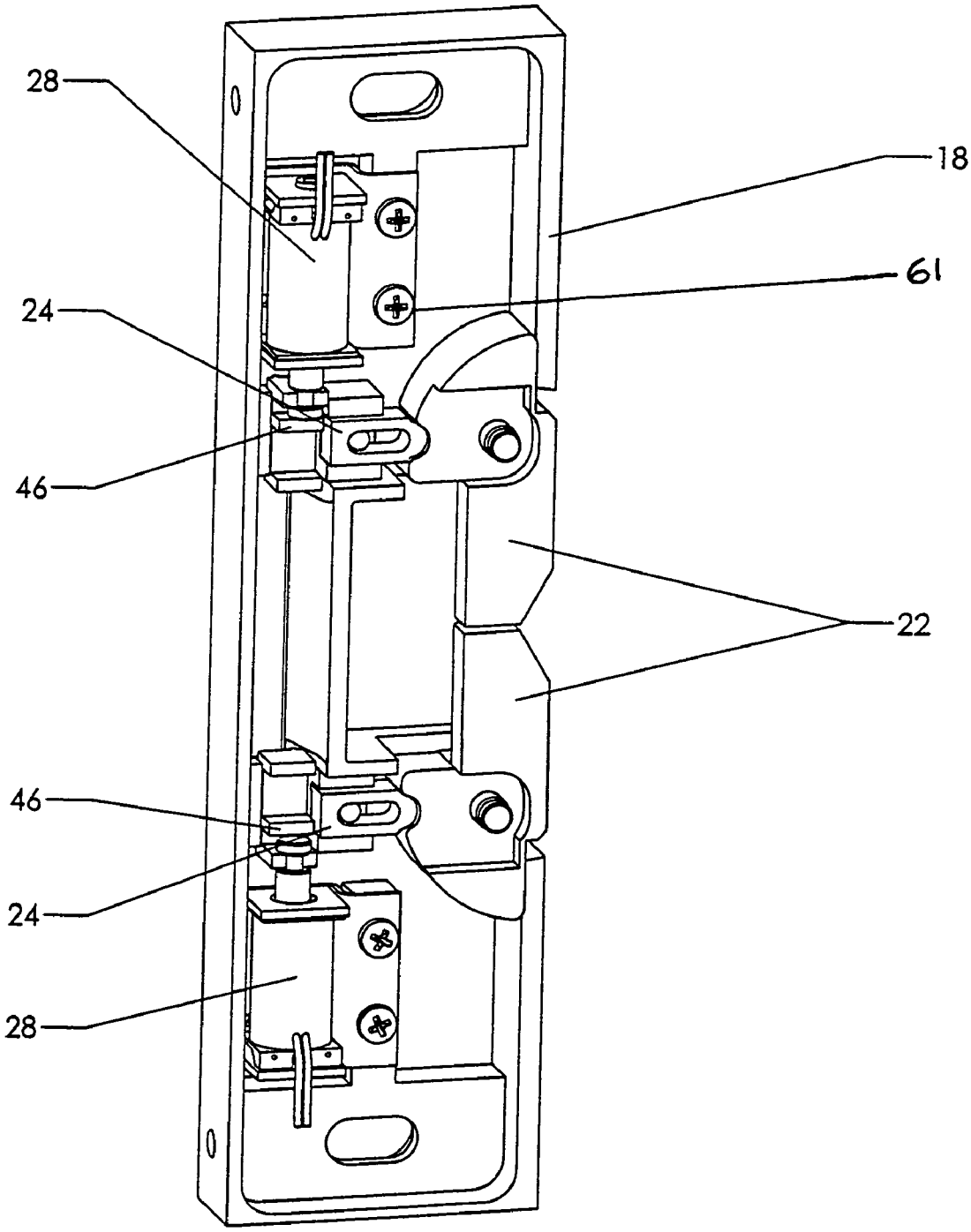
FIG. 8 is a rearview of the present invention showing the use of two solenoids and separate unlock bars to accomplish the fail secure function as above. Additionally, both solenoids could be moved outward to accomplish the fail safe mode of operation.

Other arrangements utilizing dual solenoids 28 and 28A, with dual locking bars 26, 26A may be utilized as shown in FIG. 8. In this embodiment, both solenoids 28 may be positioned at mounting screws to establish either fail secure or fail safe modes of operation.

Figure 9:
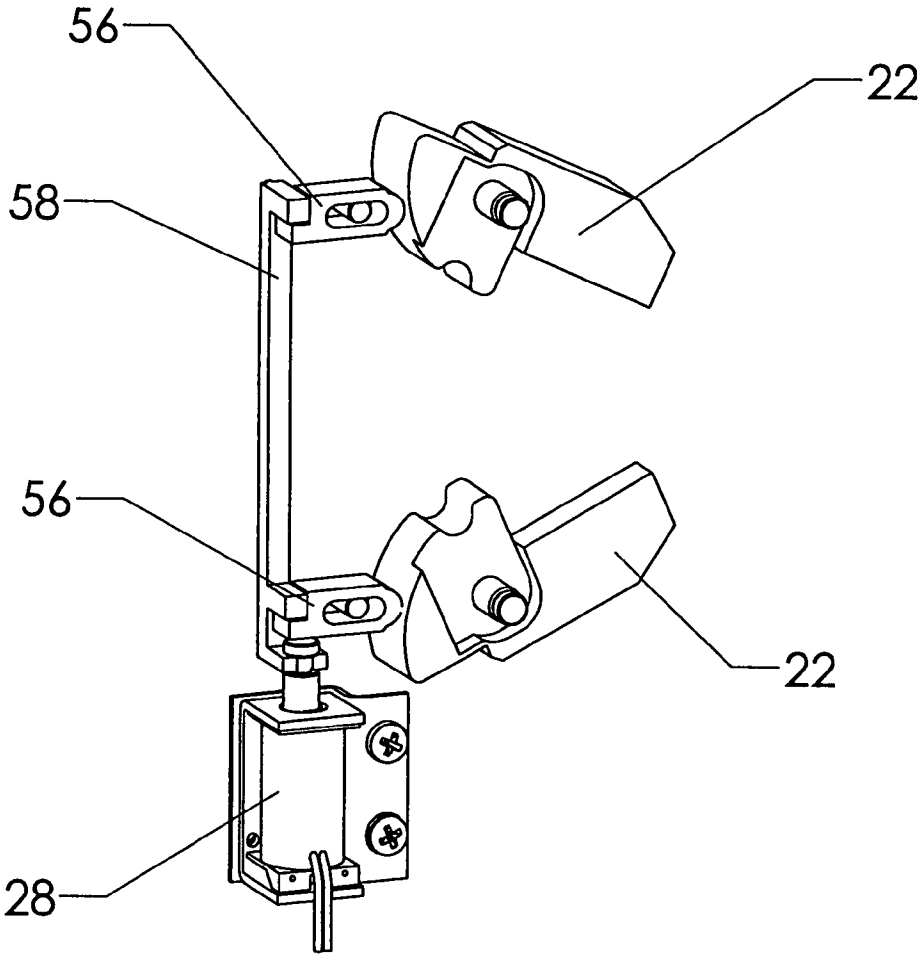
FIG. 9 is a view of the solenoid with unlock bar demonstrating another method for achieving the fail secure to fail safe conversion. In this case the notched pawls shown are substituted for the previous pawl design so that they may be flipped over to accomplish the change in mode of operation. Here the solenoid is de-energized and the release pawls are unlocked. The housing and included pawl guides have been removed for clarity.

As an alternative means for selectively positioning the locking bar in either the fail safe or fail secure mode when the operator is not energized without shifting the solenoid or solenoids, the release pawls can be notched so as to be reversible by 180 degrees along their longest axis to establish either fail safe or fail secure mode. FIG. 9 shows release pawls 56 with the cover, housing and springs removed therefrom and the associated modified unlock bar 58 having a single projecting stop 75. The release pawls are notched at 70. The notch is engaged by projection 75 in the fail safe mode. The electric strike is shown in an unlocked and fail safe mode with the solenoid de-energized. Reversal of the release pawl 56 will establish the fail secure mode.

Figure 10:
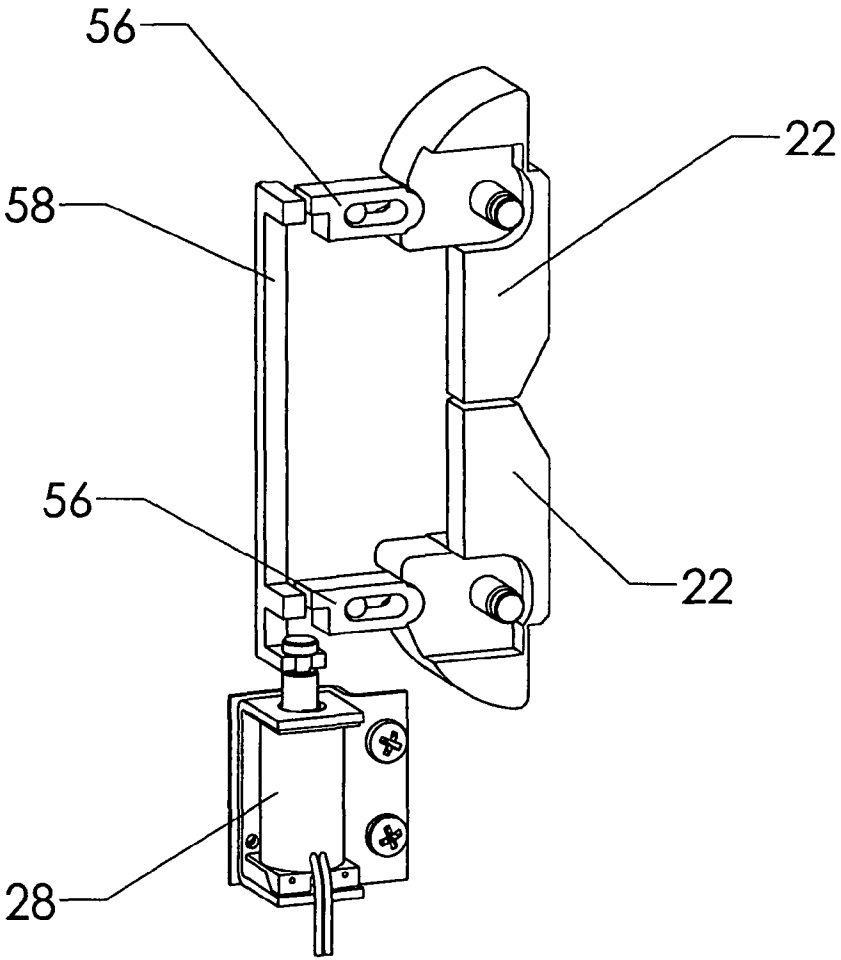
FIG. 10 is the same assembly shown in FIG. 9. In this depiction the solenoid is still de-energized but the release pawls have been flipped over and are shown in the locked state.

FIG. 10 shows the reversible release pawls 56 rotated into a locked and fail secure mode, also with the solenoid in a de-energized state.

It will be obvious to those skilled in the art to make various changes, alterations and modifications to the invention described herein. To the extent such changes, alterations and modifications do not depart from the spirit and scope of the appended claims, they are intended to be encompassed therein.

We claim:

1. An electric door strike mechanism cooperable with a latch bolt, said mechanism having a fail safe and fail secure mode, said electric door strike mechanism comprising:

(a) a housing having a cavity having an opening with opposite edges, said cavity adapted to receive a latch bolt;

(b) a first keeper having a first cam having a detent, said first keeper pivotally mounted to the housing at one edge of said opening;

(c) a second keeper having a second cam having a detent, said second keeper pivotally mounted to the housing at the other edge of the opening, said first and second keepers having a first position blocking the opening and a second open position allowing a latch bolt to enter and be withdrawn from the cavity through the opening;

(d) a first release pawl positioned adjacent said first cam and in said first position of said first keeper engaging said detent;

(e) a second release pawl positioned adjacent said second cam and in said first keeper position engaging said detent;

(f) a locking bar moveable between locked and unlocked positions, said locking bar having first and second sections, said first section being adjacent to said first pawl, and said second section being adjacent to said second pawl, said sections each having first and second stops engageable with said associated release pawl to establish either a fail safe or fail secure mode of operation;

(g) an electrically energized operator for selectively moving the locking bar between locked and unlocked positions; and (h) means for selectively positioning said locking bar in either a fail safe or fail secure mode when said operator is not energized.

2. The electric door strike mechanism of claim 1 wherein said fail safe and fail secure stops are spaced-apart and a recess is interposed between said fail safe and fail secure stops which is aligned with the associated release pawl when the locking bar is in an unlocked position.

3. The electric door strike mechanism of claim 2 wherein said means for selectively positioning said locking bar comprises adjustable mounting means associated with the electric operator.

4. The electric door strike mechanism of claim 1 wherein the operator is a solenoid having a plunger operably engaging said locking bar.

5. The electric door strike mechanism of claim 1 wherein said release pawls are spring biased to a locked position.

6. The electric door strike mechanism of claim 1 wherein said keepers are normally biased to a closed position.

7. The electric door strike mechanism of claim 1 wherein the latch bolt is a part of a rim panic exit device.

* * * * *